US008444290B2

(12) United States Patent
Opolka

(10) Patent No.: US 8,444,290 B2
(45) Date of Patent: May 21, 2013

(54) FOCUSABLE FLASHLIGHT

(75) Inventor: Rainer Opolka, Solingen (DE)

(73) Assignee: Zweibrueder Optoelectronics GmbH, Solingen (DE)

( * ) Notice: Subject to any disclaimer, the term of this patent is extended or adjusted under 35 U.S.C. 154(b) by 0 days.

(21) Appl. No.: 13/085,287

(22) Filed: Apr. 12, 2011

(65) Prior Publication Data

US 2012/0020059 A1 Jan. 26, 2012

(30) Foreign Application Priority Data

Jul. 23, 2010 (CN) ..... 2010 1 0236847

(51) Int. Cl.
*F21L 4/04* (2006.01)

(52) U.S. Cl.
USPC ..... 362/202; 362/208; 362/249.02; 362/277; 362/319

(58) Field of Classification Search
USPC ..... 362/183, 184, 187, 188, 200, 202, 362/208, 249.02, 267, 268, 800
See application file for complete search history.

(56) References Cited

U.S. PATENT DOCUMENTS

| | | | | |
|---|---|---|---|---|
| 5,021,934 | A * | 6/1991 | Hou | 362/187 |
| 5,124,894 | A * | 6/1992 | Shiau | 362/187 |
| 5,560,705 | A * | 10/1996 | Shiau | 362/188 |
| 5,765,937 | A * | 6/1998 | Shiau | 362/187 |
| 7,040,775 | B2 | 5/2006 | Opolka | |
| 2008/0259594 | A1 * | 10/2008 | Maglica | 362/202 |
| 2011/0080725 | A1 * | 4/2011 | Brands et al. | 362/187 |

* cited by examiner

*Primary Examiner* — Hargobind S Sawhney
(74) *Attorney, Agent, or Firm* — Andrew Wilford

(57) ABSTRACT

A flashlight has a casing extending along an axis and adapted to hold an electric power supply, a light source fixed at a front end of the casing and electrically energizable to emit an axially forwardly directed light beam, an annular head fitted to the casing and axially shiftable thereon. Stops engaged between the head and the casing limit axial travel of the head relative to the casing. A lens is fixed in the head so that the lens and head can be shifted to focus the light beam. Thus the lamp head is captively attached to the casing. This creates an extremely compact structure that can be assembled quickly, thereby allowing manufacturing costs to be reduced. In addition, damaged components can be replaced quickly and easily.

10 Claims, 2 Drawing Sheets

FOCUSABLE FLASHLIGHT

FIELD OF THE INVENTION

The present invention relates to a flashlight. More particularly this invention concerns a flashlight whose light beam can be focused.

BACKGROUND OF THE INVENTION

A typical flashlight has a casing extending along an axis, a light source, and a front-end lens mounted on a lamp head. The lamp head can be axially shifted relative to the light source.

More particularly as described in U.S. Pat. No. 7,040,775 such a flashlight has a convergent lens mounted at the front end, a light source, and a partially light-transparent image carrier is between the convergent lens and the light source. In order to adjust the image, the image carrier is mounted on a longitudinally or axially displaceable sliding sleeve whose longitudinal or axial displacement changes both the spacing of the light source from the convergent lens as well as the spacing of the image carrier from the convergent lens. Aside from the lamp head and the casing, at least three additional attachment elements are provided for the displaceable mounting of the image carrier—specifically, an adapter, a guide sleeve, and a sliding sleeve—with the result that manufacturing the flashlight, in particular, is relatively costly.

In addition, flashlights are well known in which, in order to focus the emitted light, the lamp head and reflector mounted therein and the casing including a light source are connected to each other by screwthreads in such a way that the reflector and the light source can be displaced relative to each other by relative rotation. This design has the disadvantage, however, that two hands are always required for focusing, the casing being held tight by one hand while the lamp head is rotated with the other hand, or vice versa.

OBJECTS OF THE INVENTION

It is therefore an object of the present invention to provide an improved focusable flashlight.

Another object is the provision of such an improved focusable flashlight that overcomes the above-given disadvantages, in particular that can be focused using one hand and that is made of only a small number of parts.

SUMMARY OF THE INVENTION

A flashlight has according to the invention a casing extending along an axis and adapted to hold an electric power supply, a light source fixed at a front end of the casing and electrically energizable to emit an axially forwardly directed light beam, an annular head fitted to the casing and axially shiftable thereon. Stops engaged between the head and the casing limit axial travel of the head relative to the casing. A lens is fixed in the head so that the lens and head can be shifted to focus the light beam. Thus according to the invention the lamp head is captively attached to the casing. This creates an extremely compact structure that can be assembled quickly, thereby allowing manufacturing costs to be reduced. In addition, damaged components can be replaced quickly and easily.

In a first embodiment of the invention, the casing stop is formed on a sleeve that is attached to the casing. In the simplest case, a threaded connection can be provided for this purpose, thereby enabling the sleeve to be screwed onto the casing. As an alternative to the above, a flange-type attachment or other releasable attachment is also conceivable. A sleeve of this type is easy to make and can therefore is inexpensive to procure. In addition, the configuration of the stop on the sleeve yields the benefit that the casing can be used with various different embodiments of the flashlight, something that would not be true at least if the stop were provided on the casing.

The sleeve here functions not only as a holder of the stop but in fact is designed as the attachment means for the light source. To this end, the light source is preferably attached to a support disk that is retained by the sleeve on the casing.

In addition, an outer guide is preferably provided that is mounted on the casing or the sleeve, and the lamp head is of a two-part design and in the assembled state surrounds the casing stop such that the lamp head is captively attached to the casing. The guide here functions to allow the lamp head to be displaced only when a force exceeding a threshold value is exerted on the head, since it is only then that friction between the guide and the lamp head is overcome. One embodiment, in which the guide is mounted on the sleeve, analogously yields the benefit that the casing can be used for various different flashlights. However, the guide can also be mounted on the casing. It is also possible to use multiple guides that are then attached to the sleeve and/or to the casing.

In a preferred embodiment of the invention, the lamp head has a front part and a back part, the lens being attached to the front part and the lamp-head stop being provided on the back part. In addition, both parts of the lamp head have complementary screwthreads so as to ensure captive attachment by passing the rear part over the casing from the rear and then screwing the front part onto the rear part. Alternatively, the parts of the lamp head can also be attached to each other by a flange connection or another releasable connection. The parts here can also be two shells that are joined together not in the axial direction but instead in the radial direction, that is along an axial plane. This way, parts of the lamp head are preferably attached by a flange. A development of this type is especially advantageous if the casing is configured such that the rear part cannot be pass over the casing—as can occur, for example, with especially thick and strong flashlight casings.

The lamp head preferably has a cylindrical guide surface against which the guide bears elastically. The configuration of the guide surfaces must be adapted accordingly for guides of other design or when a plurality of guides is is provided.

One guide that is especially advantageous is a toroidal or annular O-ring that is preferably made of an elastic material such as, for example, rubber. In this case, the guide not only functions to provide the displaceable retention of the lamp head, but also serves as a seal to prevent particles like dust from entering and contaminating into the lamp head.

In another embodiment, the light source is an LED and the support includes circular and annular, concentrically arranged electrical contacts mounted on its rear face, and an annular contact surface that is formed by a thermally conductive material, and rests on a socket-like recess of the casing. This embodiment using the electrical contact surfaces is especially appropriate for flashlights in which the batteries are mounted in a battery cartridge. Using a thermally conductive contact surface enables the entire support to be cooled by transferring heat to the casing, thereby increasing the service life of the light source being used. Preferred materials that are appropriate for this purpose include, in particular, aluminum, brass, or copper.

The support projects limitedly from the casing so as to provide a positively engaged attachment of the support to the sleeve and the casing, thereby creating an especially simple attachment of the support that at the same time is strong.

BRIEF DESCRIPTION OF THE DRAWING

The above and other objects, features, and advantages is will become more readily apparent from the following description, reference being made to the accompanying drawing in which.

DETAILED DESCRIPTION

Figure 1A:
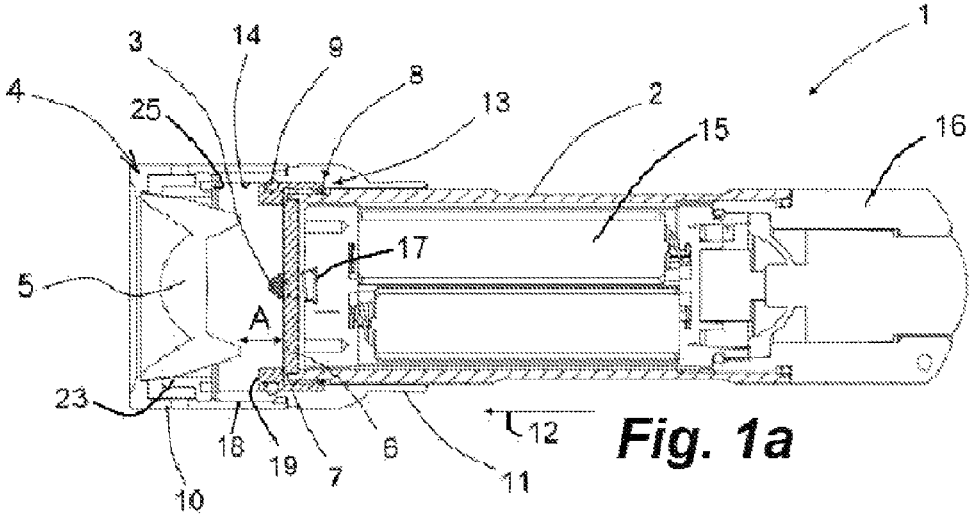
FIGS. 1*a* and 1*b* are axial sections through the flashlight according to the invention in two different positions.
Figure 1B:
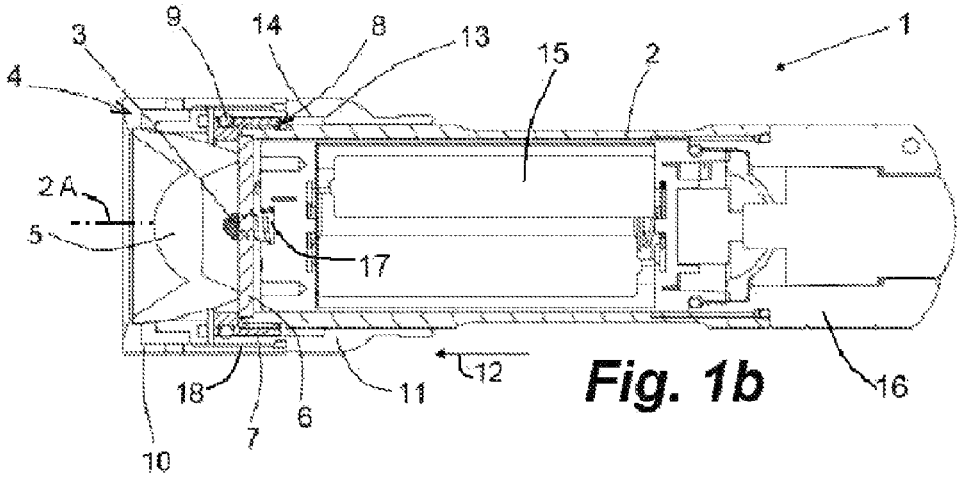
Figure 1C:
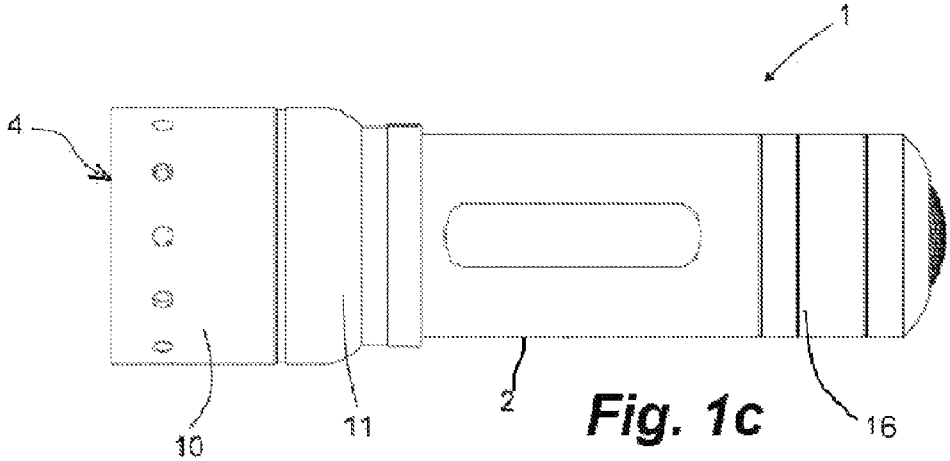
FIG. 1*c* is a side view of the flashlight.

As seen in FIGS. 1*a*-1*c* a flashlight 1 basically comprises a hollow cylindrical casing 2 centered on an axis 2A, a light source 3, a lamp head 4, and a front-end lens 5 secured therein by a mounting ring 23. The light source 3 is mounted on a support disk 6. A battery pack 15 is held in the casing 2 and engages a contact 17 on the rear face of the support. A cap 16 closes the rear end of the casing 2 and carries an unreferenced actuation button and switch.

The lens 5 is displaceable relative to the light source 3 to enable the light beam of the flashlight 1 to be focused. FIG. 1*a* here shows the lens 5 at a spacing A from the support 6 and thus from the light source 3. Conversely, in FIG. 1*b* the lens rests against the support 6, thereby minimizing the spacing is between the light source 3, and the lens 5.

In the illustrated embodiment, the support 6 is retained on the casing 2 by a cylindrical sleeve 7 centered on the axis 2A, and the sleeve 7 and the casing 2 are positively interengaged. In addition, the sleeve 7 has an annular and planar rear end face that forms a rearwardly directed stop 8. It also carries a guide 9, here an O-ring, set in a radially outwardly open groove 24 (FIG. 2*a*) of the sleeve 7.

In order to attach the lamp head 4 to the casing 2 so it can slide but is still captured, that is can move relative to the casing 2 but not be separated from it, the lamp head 4 has a front collar part 10 and a rear collar or part 11. The parts 10 and 11 are attached to each other by screwthreads 18. For assembly, the rear part 11 is slid from the rear in the direction of arrow 12 over the casing 2 for this purpose, and the front part 1 is fitted from the front to the casing 2 and screwed to the rear part 11.

Sliding travel is limited here by the stop 8 formed on the sleeve 7 and a complementary stop 13 formed by a forwardly directed, annular and planar shoulder face on the rear part 11. Rearward movement of the head 4 on the casing 2 is limited by engagement of a planar and front face 19 of the sleeve 7 with a rear face 25 of the ring 23, with the result that the lamp head 4 is captured on the casing 2 for limited axial movement.

The O-ring guide 9 bears outward on a cylindrical inner surface 14 of the rear part 11 to prevent the lamp head 4 from shifting unintentionally. In order to replace the guide 9 when it wears out, the lamp head 4 must simply be unscrewed and the rear part slid in a direction opposite to that of arrow 12 until the guide 9 is exposed and can be removed.

Figure 2A:
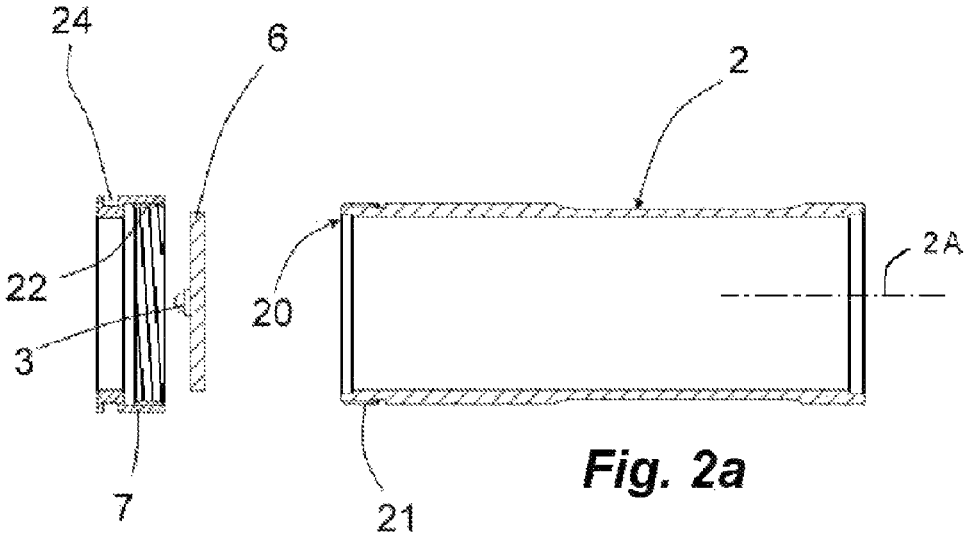
FIGS. 2*a* and 2*b* are axial sections through the housing assembly of this invention, in exploded and assembled condition.
Figure 2B:
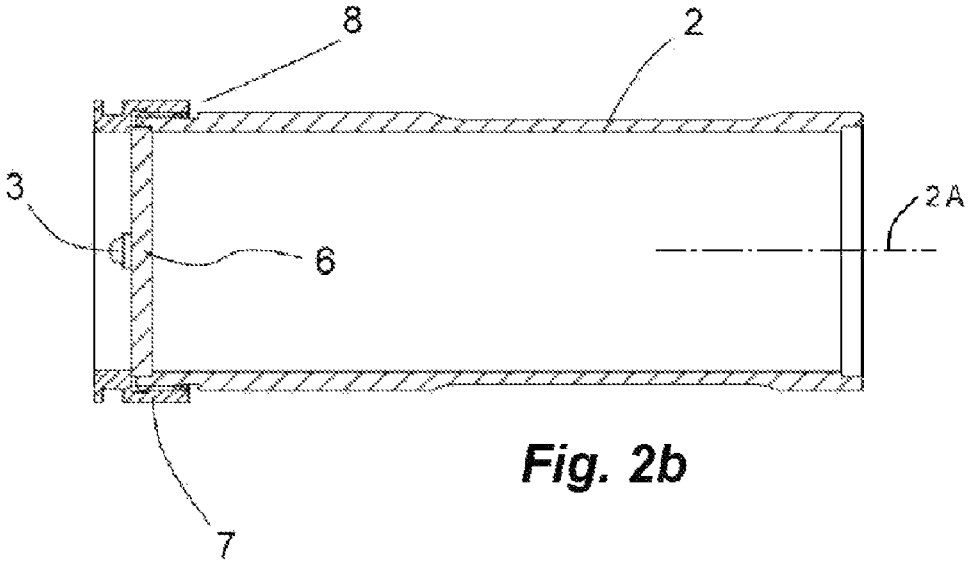

FIGS. 2*a* and 2*b* show the casing 2, the support 6, and the sleeve 7. The casing 2 has an inset with an axially forwardly directed, annular and planar shoulder face that forms a recessed seat 20 against which the support 6 is fitted. An external screw thread 21 is provided at the front end of the casing 2 so a complementary internal screwthread 22 of the sleeve 7 can be screwed onto the casing 2. The support 6 is thus positively held between the sleeve 7 and the casing 2. The rear end of this support, which is thermally conductive, is thus in good heat-transmitting engagement with the casing 2 so that heat generated by the LED light source 3 can be dissipated via the support 6 and housing 2. In addition the rear face of the support disk 2 carries as mentioned above the contact 17 and unillustrated contact traces for connection to the battery pack 16.

I claim:

1. A flashlight comprising a casing extending along an axis and adapted to hold an electric power supply;

a light source fixed at a front end of the casing and electrically energizeable to emit an axially forwardly directed light beam;

an annular head fitted to the casing, axially shiftable thereon, and having a substantially planar, annular, and forwardly directed edge face forming a rear stop;

a front-end sleeve forming a rearwardly directed other front stop and, forwardly of the front stop, a forwardly directed end face, the head having a rearwardly directed face engageable with the forwardly directed end face for limiting rearward travel of the head relative to the casing;

screwthreads releasably attaching the sleeve to the casing, the front and rear stops limiting forward axial travel of the head relative to the casing; and a lens fixed in the head, whereby the lens and head can be shifted to focus the light beam.

2. The flashlight defined in claim 1 wherein the head is formed of a front part, a rear part, and a releasable connection between the parts, the rear part being formed with the other forwardly directed stop.

3. The flashlight defined in claim 1 wherein the releasable connection is formed by screwthreads.

4. The flashlight defined in claim 1, further comprising a support disk carrying the light source and held between the sleeve and the casing.

5. The flashlight defined in claim 4 wherein the casing is formed with a radially inwardly and axially forwardly inset seat receiving an outer edge of the support disk.

6. The flashlight defined in claim 5 wherein the disk, when in the seat, projects axially forward past a front edge face of the casing.

7. The flashlight defined in claim 5 wherein the support disk and casing are thermally conductive so as to transmit heat from the light source to the casing.

8. The flashlight defined in claim 1, further comprising a guide engaged radially between the casing and the head and inhibiting but not preventing relative axial movement of the casing and the head.

9. The flashlight defined in claim 8 wherein the guide is an elastically compressible O-ring.

10. The flashlight defined in claim 9 wherein the casing is formed with a radially outwardly open groove in which the O-ring is set and the head has a cylindrical inner surface against which the O-ring bears elastically.

* * * * *